US010104906B1

(12) United States Patent
Griesmayr et al.

(10) Patent No.: US 10,104,906 B1
(45) Date of Patent: Oct. 23, 2018

(54) MOUTHPIECE LINING PAPER

(71) Applicant: TANNPAPIER GMBH, Traun (AT)

(72) Inventors: Guenter Griesmayr, Wels (AT); Barbara Puehringer, Oftering (AT); Bernhard Knauseder, Leonding (AT); Eike Schopper, Hoersching (AT)

(73) Assignee: TANNPAPIER GMBH, Traun (AT)

( * ) Notice: Subject to any disclaimer, the term of this patent is extended or adjusted under 35 U.S.C. 154(b) by 0 days.

(21) Appl. No.: 16/018,431

(22) Filed: Jun. 26, 2018

Related U.S. Application Data

(63) Continuation of application No. 14/428,727, filed as application No. PCT/AT2013/050186 on Sep. 16, 2013.

(30) Foreign Application Priority Data

Sep. 17, 2012 (AT) ..... A 1015/2012

(51) Int. Cl.

| | |
|---|---|
| ***A24D 1/02*** | (2006.01) |
| ***A24B 15/28*** | (2006.01) |
| ***A24D 3/04*** | (2006.01) |
| ***A24D 3/18*** | (2006.01) |

(52) U.S. Cl.
CPC ..... *A24D 1/02* (2013.01); *A24B 15/282* (2013.01); *A24D 3/04* (2013.01); *A24D 3/18* (2013.01)

(58) Field of Classification Search
CPC ... A24D 1/02; A24D 3/04; A24D 3/18; A24B 15/282
See application file for complete search history.

(56) References Cited

U.S. PATENT DOCUMENTS

| | | | |
|---|---|---|---|
| 2,001,709 | A | 5/1935 | Davidson |
| 2,755,206 | A | 7/1956 | Statia |
| 3,039,367 | A | 6/1962 | Stelzer |
| 3,052,163 | A | 9/1962 | Schubert |
| 3,052,164 | A | 9/1962 | Rowlands |
| 3,064,541 | A | 11/1962 | Mantchev |
| 3,199,418 | A | 8/1965 | Schubert |
| 3,267,820 | A | 8/1966 | Molins et al. |
| 3,288,147 | A | 11/1966 | Molins et al. |
| 3,297,038 | A | 1/1967 | Homburger |
| 3,308,600 | A | 3/1967 | Erdmann et al. |
| 3,308,832 | A | 3/1967 | Stelzer et al. |
| 3,312,151 | A | 4/1967 | Molins |
| 3,312,152 | A | 4/1967 | Williamson |
| 3,339,557 | A | 9/1967 | Karalus |
| 3,339,558 | A | 9/1967 | Waterbury |
| 3,348,455 | A | 10/1967 | Williamson et al. |
| 3,366,121 | A | 1/1968 | Carty |
| 3,373,750 | A | 3/1968 | Beam |
| 3,390,039 | A | 6/1968 | Caughman et al. |
| 3,390,686 | A | 7/1968 | Irby, Jr. et al. |
| 3,420,242 | A | 1/1969 | Boukair |
| 3,424,172 | A | 1/1969 | Neurath et al. |
| 3,428,049 | A | 2/1969 | Leake et al. |
| 3,460,959 | A | 8/1969 | Neuhaus |
| 3,464,324 | A | 9/1969 | Pinkham |
| 3,464,421 | A | 9/1969 | Pinkham et al. |
| 3,547,130 | A | 2/1970 | Harlow et al. |
| 3,508,558 | A | 4/1970 | Seyburn |
| 3,513,859 | A | 5/1970 | Carty |
| 3,547,009 | A | 12/1970 | Molins |
| 3,550,508 | A | 12/1970 | Wartman, Jr. |
| 3,575,180 | A | 4/1971 | Carty |
| 3,596,665 | A | 8/1971 | Lindgard |
| 3,602,231 | A | 8/1971 | Dock |
| 3,610,112 | A | 10/1971 | Labbe |
| 3,623,404 | A | 11/1971 | Jackson |
| 3,625,228 | A | 12/1971 | Dock |
| 3,635,226 | A | 1/1972 | Horsewell et al. |
| 3,638,661 | A | 2/1972 | Pinkham |
| 3,669,128 | A | 6/1972 | Cohen |
| 3,685,521 | A | 8/1972 | Dock |
| 3,797,644 | A | 3/1974 | Shaw |
| 3,915,176 | A | 10/1975 | Heitmann et al. |
| 3,916,914 | A | 11/1975 | Brooks et al. |
| 3,972,335 | A | 8/1976 | Tiggelbeck et al. |
| 3,991,773 | A | 11/1976 | Walker |
| 4,003,387 | A | 1/1977 | Goldstein |
| 4,043,539 | A | 8/1977 | Gilmer et al. |
| 4,046,153 | A | 9/1977 | Kaye |
| 4,059,043 | A | 11/1977 | Berger |
| 4,082,098 | A | 4/1978 | Owens, Jr. |
| 4,121,595 | A | 10/1978 | Heitmann et al. |
| 4,126,141 | A | 11/1978 | Grossman |
| 4,174,719 | A | 11/1979 | Martin et al. |
| 4,175,479 | A | 11/1979 | Roullier |
| 4,184,412 | A | 1/1980 | Hall |
| 4,185,643 | A | 1/1980 | Riedesser |
| 4,222,672 | A | 9/1980 | Shaw |
| 4,280,187 | A | 7/1981 | Reuland et al. |
| 4,281,591 | A | 8/1981 | Boegli et al. |
| 4,281,670 | A | 8/1981 | Heitmann et al. |
| 4,281,671 | A | 8/1981 | Bynre et al. |
| 4,286,605 | A | 9/1981 | Goslin et al. |
| 4,291,711 | A | 9/1981 | Berger |
| 4,291,713 | A | 9/1981 | Frank |
| 4,295,478 | A | 10/1981 | Yeatts |
| 4,331,166 | A | 5/1982 | Hale |
| 4,361,156 | A | 11/1982 | Hall |

(Continued)

FOREIGN PATENT DOCUMENTS

| | | |
|---|---|---|
| AT | 260756 | 3/1968 |
| CN | 88103246 | 12/1988 |

(Continued)

OTHER PUBLICATIONS

Definition of "lacquer", The Free Dictionary by Farlex, [online], No Date, retrieved fron the Internet on May 8, 2015, URL: http//www.thefreedictionary.com/lacquer.

(Continued)

*Primary Examiner* — Anthony Calandra
(74) *Attorney, Agent, or Firm* — Brooks Kushman P.C.

(57) ABSTRACT

A mouthpiece lining paper for an article to smoke such as a filter cigarette or a cigarillo provided with a filter. The mouthpiece lining paper is imprinted with a coating which can have an optical, haptical or other function. The mouthpiece lining paper has on its inner side, an additional sealing layer formed from a coating.

16 Claims, No Drawings

(56) References Cited

U.S. PATENT DOCUMENTS

| | | | |
|---|---|---|---|
| 4,411,279 | A | 10/1983 | Martin et al. |
| 4,411,640 | A | 10/1983 | Hall |
| 4,434,805 | A | 3/1984 | Hall |
| 4,474,190 | A | 10/1984 | Brand |
| 4,476,807 | A | 10/1984 | Pryor |
| 4,549,875 | A | 10/1985 | Pryor |
| 4,574,816 | A | 3/1986 | Rudszinat |
| 4,583,558 | A | 4/1986 | Luke |
| 4,614,199 | A | 9/1986 | Berger |
| 4,643,205 | A | 2/1987 | Redding et al. |
| 4,675,064 | A | 6/1987 | Berger |
| 4,677,995 | A | 7/1987 | Kallianos et al. |
| 4,729,391 | A | 3/1988 | Woods et al. |
| 4,736,754 | A | 4/1988 | Heitmann et al. |
| 4,781,203 | A | 11/1988 | La Hue |
| 4,807,809 | A | 2/1989 | Pryor et al. |
| 4,811,745 | A | 3/1989 | Cohen et al. |
| 4,836,224 | A | 6/1989 | Lawson et al. |
| 4,844,100 | A | 7/1989 | Holznagel |
| 4,848,375 | A | 7/1989 | Patron et al. |
| 4,850,301 | A | 7/1989 | Greene, Jr. et al. |
| 4,859,936 | A | 8/1989 | Eccleston |
| 4,862,905 | A | 9/1989 | Green, Jr. et al. |
| 4,865,056 | A | 9/1989 | Tamaoki et al. |
| 4,869,275 | A | 9/1989 | Berger |
| 4,878,506 | A | 11/1989 | Pinck et al. |
| 4,889,144 | A | 12/1989 | Tateno et al. |
| 4,924,888 | A | 5/1990 | Perfetti et al. |
| 4,925,602 | A | 5/1990 | Hill et al. |
| 4,941,486 | A | 7/1990 | Dube et al. |
| 5,012,823 | A | 5/1991 | Keritsis et al. |
| 5,012,829 | A | 5/1991 | Thesing et al. |
| 5,025,814 | A | 6/1991 | Raker |
| 5,056,537 | A | 10/1991 | Brown et al. |
| 5,060,664 | A | 10/1991 | Stems et al. |
| 5,060,665 | A | 10/1991 | Heitmann |
| 5,156,169 | A | 10/1992 | Holmes et al. |
| 5,191,906 | A | 3/1993 | Myracle, Jr. |
| 5,220,930 | A | 6/1993 | Gentry |
| 5,225,277 | A | 7/1993 | Takegawa et al. |
| 5,271,419 | A | 12/1993 | Arzonico et al. |
| 5,331,981 | A | 7/1994 | Tamaoki et al. |
| 5,360,023 | A | 11/1994 | Blakley et al. |
| 5,387,285 | A | 2/1995 | Rivers |
| 5,695,441 | A | 12/1997 | Irikura |
| 5,724,997 | A | 3/1998 | Smith et al. |
| 6,202,650 | B1 | 3/2001 | Kaneki et al. |
| 6,229,115 | B1 | 5/2001 | Voss et al. |
| 6,360,751 | B1 | 3/2002 | Fagg et al. |
| 6,584,979 | B2 | 7/2003 | Xue et al. |
| 6,595,218 | B1 | 7/2003 | Koller et al. |
| 6,631,722 | B2 | 10/2003 | MacAdam et al. |
| 6,647,870 | B2 | 11/2003 | Kohno |
| 6,656,412 | B2 | 12/2003 | Ercelebi et al. |
| 6,701,934 | B2 | 3/2004 | Schlisio et al. |
| 6,701,936 | B2 | 3/2004 | Shafer et al. |
| 6,723,033 | B1 | 4/2004 | Scott et al. |
| 6,761,174 | B2 | 7/2004 | Jupe et al. |
| 6,779,530 | B2 | 8/2004 | Kraker |
| 6,832,613 | B2 | 12/2004 | Brunbauer |
| 6,837,281 | B2 | 1/2005 | Spiers et al. |
| 6,848,449 | B2 | 2/2005 | Kitao et al. |
| 6,904,917 | B2 | 6/2005 | Kitao et al. |
| 6,929,013 | B2 | 8/2005 | Ashcraft et al. |
| 7,004,896 | B2 | 2/2006 | Heitmann et al. |
| 7,074,170 | B2 | 7/2006 | Lanier, Jr. et al. |
| 7,115,085 | B2 | 10/2006 | Deal |
| 7,205,066 | B1 | 4/2007 | Hammi et al. |
| 7,210,486 | B2 | 5/2007 | Hartmann |
| 7,234,471 | B2 | 6/2007 | Fitzgerald et al. |
| 7,237,559 | B2 | 7/2007 | Ashcraft et al. |
| 7,240,678 | B2 | 7/2007 | Crooks et al. |
| 7,275,548 | B2 | 10/2007 | Hancock et al. |
| 7,281,540 | B2 | 10/2007 | Barnes et al. |
| 7,296,578 | B2 | 11/2007 | Read, Jr. |
| 7,338,421 | B2 | 3/2008 | Eusepi et al. |
| 7,434,585 | B2 | 10/2008 | Holmes |
| 7,479,098 | B2 | 1/2009 | Thomas et al. |
| 7,565,818 | B2 | 7/2009 | Thomas et al. |
| 7,578,298 | B2 | 8/2009 | Karles et al. |
| 7,740,019 | B2 | 6/2010 | Nelson et al. |
| 7,793,665 | B2 | 9/2010 | Dube et al. |
| 7,836,895 | B2 | 11/2010 | Dube et al. |
| 7,878,962 | B2 | 2/2011 | Karles et al. |
| 7,922,638 | B2 | 4/2011 | Draghetti et al. |
| 7,972,254 | B2 | 7/2011 | Stokes et al. |
| 8,262,550 | B2 | 9/2012 | Barnes et al. |
| 8,408,216 | B2 | 4/2013 | Luan et al. |
| 8,496,569 | B2 | 7/2013 | Balletti et al. |
| 8,720,451 | B2 | 5/2014 | Bartram |
| 8,905,042 | B2 | 12/2014 | Zhang et al. |
| 9,060,545 | B2 | 6/2015 | Besso et al. |
| 2002/0119873 | A1 | 8/2002 | Heitmann |
| 2003/0136419 | A1 | 7/2003 | Muller |
| 2003/0178039 | A1 | 9/2003 | White et al. |
| 2004/0255965 | A1 | 12/2004 | Perfetti et al. |
| 2005/0066986 | A1 | 3/2005 | Nestor et al. |
| 2005/0196604 | A1 | 9/2005 | Funicelli et al. |
| 2006/0112964 | A1 | 6/2006 | Jupe et al. |
| 2006/0144412 | A1 | 7/2006 | Mishra et al. |
| 2007/0246055 | A1 | 10/2007 | Oglesby |
| 2008/0029111 | A1 | 2/2008 | Dube et al. |
| 2008/0156336 | A1 | 7/2008 | Wyss-Peters et al. |
| 2009/0025736 | A1 | 1/2009 | Stewart et al. |
| 2010/0108081 | A1 | 5/2010 | Blevins Joyce et al. |
| 2010/0108084 | A1 | 5/2010 | Norman et al. |
| 2011/0155000 | A1 | 6/2011 | Kaljura et al. |
| 2012/0240948 | A1 | 9/2012 | Griesmayr |
| 2013/0093117 | A1 | 4/2013 | Griesmayr |
| 2013/0139837 | A1 | 6/2013 | Kaljura et al. |
| 2013/0167851 | A1 | 7/2013 | Ademe et al. |
| 2013/0199550 | A1 | 8/2013 | Ono |

FOREIGN PATENT DOCUMENTS

| | | |
|---|---|---|
| CN | 2193654 | 4/1995 |
| CN | 1849209 | 10/2006 |
| CN | 101296627 | 10/2008 |
| CN | 201141102 | 10/2008 |
| CN | 201365521 | 12/2009 |
| CN | 201365522 | 12/2009 |
| CN | 102227174 | 10/2011 |
| CN | 202157246 | 3/2012 |
| CN | 102404999 | 4/2012 |
| CN | 202416072 | 9/2012 |
| CN | 202430593 | 9/2012 |
| DE | 630817 | 6/1936 |
| DE | 1928432 | 12/1965 |
| DE | 1532252 | 2/1970 |
| DE | 1757235 | 4/1971 |
| DE | 2327822 | 12/1974 |
| DE | 2743986 | 4/1979 |
| DE | 2927893 | 10/1984 |
| DE | 3005793 | 5/1985 |
| DE | 3411511 | 6/1995 |
| DE | 102005025758 | 12/2006 |
| EP | 0295518 | 12/1988 |
| EP | 0539009 | 4/1993 |
| EP | 0838166 | 4/1998 |
| EP | 1044615 | 10/2000 |
| EP | 1891866 | 2/2008 |
| EP | 1942753 | 5/2009 |
| EP | 1895863 | 12/2009 |
| GB | 269194 | 12/1927 |
| GB | 294492 | 7/1928 |
| GB | 334271 | 9/1930 |
| GB | 337501 | 11/1930 |
| GB | 433228 | 8/1935 |
| GB | 1422286 | 1/1976 |
| GB | 2135912 | 9/1984 |
| GB | 2199726 | 7/1988 |
| JP | 2005523680 | 8/2005 |
| JP | 2007527338 | 9/2007 |
| JP | 2009148233 | 7/2009 |

(56) References Cited

FOREIGN PATENT DOCUMENTS

| | | |
|---|---|---|
| JP | 2012507287 | 3/2012 |
| JP | 2013505729 | 2/2013 |
| JP | 2013529090 | 7/2013 |
| WO | 0051451 | 9/2000 |
| WO | 0158289 | 8/2001 |
| WO | 0237990 | 5/2002 |
| WO | 03000971 | 1/2003 |
| WO | 03009711 | 2/2003 |
| WO | 03016137 | 2/2003 |
| WO | 2004047572 | 6/2004 |
| WO | 2004052128 | 6/2004 |
| WO | 2004057986 | 7/2004 |
| WO | 2006090290 | 8/2006 |
| WO | 2006128551 | 12/2006 |
| WO | 2006136197 | 12/2006 |
| WO | 2006136199 | 12/2006 |
| WO | 2007010407 | 1/2007 |
| WO | 2007052170 | 5/2007 |
| WO | 2007060543 | 5/2007 |
| WO | 2008019281 | 2/2008 |
| WO | 2008154539 | 12/2008 |
| WO | 2009027331 | 3/2009 |
| WO | 2010051076 | 5/2010 |
| WO | 2011001200 | 1/2011 |
| WO | 2011038430 | 4/2011 |
| WO | 2011042353 | 4/2011 |
| WO | 2011060459 | 5/2011 |
| WO | 2011154246 | 12/2011 |
| WO | 2012049880 | 4/2012 |
| WO | 2013046327 | 4/2013 |

OTHER PUBLICATIONS

International Search Report for PCT/AT2013/050186, English translation attached to original, Both completed by the European Patent Office on Feb. 20, 2014, All together 5 Pages.

Japanese Office Action for Japanese Application No. JP2015-531401, English translation attached to original, Both completed by the Japanese Patent Office, dated Apr. 25, 2017, 6 Pages all together.

Japanese Search Report for Japanese Application No. JP 2015-531401, English translation attached to original, Both completed by the Japanese Patent Office, dated Apr. 18, 2017, 28 Pages all together.

MOUTHPIECE LINING PAPER

CROSS-REFERENCE TO RELATED APPLICATIONS

This application is a continuation of U.S. Ser. No. 14/428,727 filed Mar. 17, 2015 which is the U.S. national phase of PCT Application No. PCT/AT2013/050186 filed on Sep. 16, 2013, which claims priority to AT Patent Application No. A 1015/2012 filed on Sep. 17, 2012, the disclosures of which are incorporated in their entirety by reference herein.

TECHNICAL FIELD

The invention relates to a mouthpiece lining paper for a smoking article such as a filter cigarette or a cigarillo provided with a filter.

The invention is described with regard to mouthpiece lining paper that is applied to cigarettes, although it can also be applied to cigarillos, as long as they are provided with a filter.

Main parts of a conventional filter cigarette are the tobacco rod, the cigarette paper wrapped around the latter, the filter, the filter paper wrapped directly around the latter and the mouthpiece lining paper.

The mouthpiece lining paper, often also referred to as "tipping paper" or "tipping" for short, is that part of the filter cigarette which, during the smoking of the filter cigarette, is touched by the lips of the person smoking the cigarette. It encloses the filter part and usually also protrudes slightly in the longitudinal direction of the filter cigarette into the longitudinal region of the tobacco rod, where it encloses the cigarette paper. It is joined to the filter paper and the cigarette paper by an adhesive bond. By producing this adhesive bond, the filter part and the tobacco rod part are mechanically joined in the cigarette-making machine. The mouthpiece lining paper is usually actually a paper, but it may also be a foil (often also referred to as a "film") or else a composite material comprising multiple layers of different materials.

The mouthpiece lining paper usually has an imprint. This imprint may for example resemble cork.

BACKGROUND

In GB433228 A, it was already proposed back in 1934 to make the cigarette paper of filterless cigarettes be impregnated with nitrocellulose lacquer, at least at one end, the end intended to be touched by the lips during smoking. Advantages are said to include that the emission of constituents of the smoke to the lips is reduced, that the cigarette paper becomes less wet when touched by the lips and that the cigarette paper sticks less to the lips.

The documents U.S. Pat. No. 2,755,206 A, U.S. Pat. No. 3,916,914 A, CN 2193654 Y and EP 1895863 B1 describe cigarette filters that have substances stored in the filter core, such as typically aromatic substances in liquid form, these substances typically being kept in a capsule that can be broken open by an external compressive force whenever the substance can come into contact with the stream of smoke from the tobacco part of the cigarette and can develop its effect. In order that the liquid, typically oily, substance does not saturate and discolor the mouthpiece lining paper, that is to say the outermost enclosing layer of the filter of the finished cigarette, the mouthpiece lining paper and the filter core containing the liquid substance are separated by a circular-cylindrical intermediate layer of a liquid-impermeable separating material.

GB 1422286 A1 and DE 2327822 A1 describe a mouthpiece lining paper that consists of a film of plastic and has on its outside an additional imprinted lacquer coating. This additional imprint may have been applied in two layers.

DE 630817 C describes a mouthpiece lining paper that has a layer of real gold on the outside. For this purpose, a first lacquer coating is applied to the mouthpiece lining paper and the layer of gold is applied cathodically to said first coating. A further lacquer coating is applied over the layer of gold in order to reduce abrasion.

GB 269194 A describes a mouthpiece lining paper on the outside of which there has been applied a layer of pulverized mica, which is applied in a mixture with a lacquer. A further lacquer coating is applied over this layer of mica.

US 20080029111 A describes a mouthpiece lining paper formed by two layers, the smoker being able to remove the outer layer. If the inner layer comprises a coating with sensory substances, the outer layer serves the purpose of protecting the coating of the inner layer from external influences.

In DE 1928432 U and DE 1532252 A1 it is proposed to impregnate the longitudinal region of filter cigarettes that are touched by the lips during smoking with a deodorizing agent or flavoring, in order to prevent substances contained in the smoke, unpleasant-tasting substances, from acting on the lips. It is also proposed to make the region of the surface that is provided with such an agent distinguishable in color from adjoining regions of the surface by an imprint.

In US 20030178039 A1 there is described a mouthpiece lining paper that includes 20 to 70% by weight of a water-dispersible cellulose material, 20 to 70% by weight of a water-soluble film-forming material and 0 to 10% by weight of a humectant. This mouthpiece lining paper is printed on the outside and coated with a layer of lip-release coating. A lip-release coating is understood as meaning a substance that prevents the lips from sticking to the mouthpiece lining paper and is usually applied as a lacquer.

In DE 2743986 A1 it is proposed to achieve an improved luster effect by applying a lacquer coating to the outside of a mouthpiece lining paper that has a kind of surface that is made to resemble cork by being provided with stamped depressions. This effect is obtained by the lacquer coating penetrating less into the paper in the stamped, and therefore densified, regions than in the other regions. It therefore has a glossy effect in the depressions and a matt effect elsewhere.

WO 2009/027331 A2 shows a mouthpiece lining paper that has on the outside a coating comprising substances with a cooling effect. The substance with a cooling effect is applied with a carrier substance or solvent (carrier lacquer). This is nitrocellulose lacquer, since it has low resistance to moisture. It is thus possible to take in the substance with a cooling effect over the lips even when the applied coating with a cooling effect is covered by an additional coating with the carrier lacquer. In a configurational variant, the mouthpiece lining paper is already provided with the carrier lacquer before the application of the substance with a cooling effect. This achieves the effect that migration of the substance with a cooling effect into the filter of the cigarette during storage is reduced. It is disadvantageous that the lacquer that is used for the pretreatment of the mouthpiece lining paper is the same that is also used as a solvent of the substance with a cooling effect. As a result, there is migration of the substance with a cooling effect through the lacquer coating, especially in the presence of moisture.

According to WO 2009/027331 A2, this migration through the lacquer coating is even required, to allow outward migration of the substance with a cooling effect to the lips of the smoker.

SUMMARY

With regard to the imprinting of mouthpiece lining paper, the type of printing material, printing method and applied amount of printing material are chosen or set in such a way that the imprint is certain to withstand completely the stresses to which it is subjected during the production of the cigarettes, packing, transportation and storage of the cigarettes, and of course during the smoking of the cigarettes, and consequently no disturbing side effects, such as discoloration etc., are caused by the imprint. According to the methods disclosed by the prior art, that is achieved by applying to the outside of the mouthpiece lining paper an imprint that is protected by a sealing layer applied over it. While this means that the imprint can already be well protected from external influences, there is still no satisfactory, simple way of protecting the imprint from influences from inside the cigarette.

The object on which the invention is based is aimed at extending the possibilities of choice for imprints for the mouthpiece lining paper of a cigarette with regard to the type, amount and combinability of imprinting materials. The prime intention of this is to prevent the migration of substances from inside the cigarette into the imprint, additionally achieving the effect that the migration of contents of the imprint into the interior of the cigarette is also prevented.

In the present document, imprinting is understood as meaning the application of lacquer, which may have a visual or haptic function and/or contain sensory substances. The term "sensory substance" is understood as meaning substances with a sensory function, such as for example aromatic substances or flavorings. Furthermore, in this document, substances that are capable of retaining or breaking down odorants as well as substances with a bleaching effect are also subsumed under the term sensory substances.

To achieve the object, it is proposed to provide the inside of the mouthpiece lining paper after imprinting with a sealing lacquer coating that prevents migration.

In this sense, a lacquer is a liquid or else powdered coating substance that is applied thinly to articles and forms a continuous solid film, known as a lacquer coating, by chemical or physical processes. Preferably, the sealing lacquer coating is transparent. More preferably, it is colorless.

It has surprisingly been found that the nitrocellulose lacquer much used in the prior art is only suitable to a limited extent as the lacquer with which the sealing lacquer coating can be formed, since nitrocellulose lacquer is only moisture-resistant to a limited extent. On contact with moisture, therefore, the imprint under the lacquer is only protected for a certain time, which is dependent on the layer thickness of the lacquer. Moreover, the substances bound in the lacquer are released, which in the cited WO 2009/027331 A2 is used to allow the migration of the substance with a cooling effect to the lips of the smoker.

In order to prevent the migration of substances into the imprint and out of the imprint, even in the presence of moisture, it is proposed according to the invention to use a moisture-resistant lacquer, such as shellac, ethyl cellulose lacquer or polyethylene wax.

After imprinting the mouthpiece lining paper with lacquer that may have a visual and/or haptic function, and may contain sensory substances, the additional sealing, moisture-resistant lacquer coating provided according to the invention may be provided either by applying the sealing lacquer on one side, on the inside of the mouthpiece lining paper, or by impregnating the mouthpiece lining paper with sealing lacquer on both sides. In the case of the second method, the imprint is also protected from external influences, in particular from moisture. It is also possible to use a different lacquer for the sealing layer applied on the outside than for the inner layer. For example, if substances from the imprint are intended to reach the lips, a water-soluble lacquer, or a less moisture-resistant lacquer, such as nitrocellulose lacquer, may be used.

It is particularly advantageous to apply the sealing layer on that side of the mouthpiece lining paper that forms the inside of the mouthpiece lining paper on the finished cigarette when a lacquer for another function has already been applied to the inside of the mouthpiece lining paper. For example, this first-applied lacquer may be a lacquer by which the opacity of the mouthpiece lining paper is specifically set. Imprinting and sealing on the inside is also particularly advantageous when using transparent or translucent mouthpiece lining paper. The paper is such a transparent or translucent mouthpiece lining paper if, for example, it consists of a very thin paper, or of a film such as cellophane.

Imprinting on the inside has the effect that, after the assembly of the cigarette, the imprint is protected outwardly by the mouthpiece lining paper itself. Inwardly, the imprint is protected by the sealing layer, which is particularly advantageous during the gluing of the mouthpiece lining paper to the layer of the cigarette lying under it, since in this way the imprint is protected from the glue, or the moisture contained in the glue.

This protection from the moisture that inevitably occurs in the course of the gluing is also advantageous if water-soluble substances, such as sensory substances, are present in the imprint, since these tend to migrate into deeper layers of the cigarette during the gluing.

In the case of most applications, very good results are achieved with little effort by the sealing layer being applied only on one side, but for that being applied in multiple layers repeatedly in successively performed operations.

The methods that are customary for impregnating and/or imprinting mouthpiece lining papers may be used for applying the sealing lacquer coating.

The required amount of sealing lacquer per unit area of paper depends on the porosity of the mouthpiece lining paper used, and possibly on the type and amount of the lacquer of the imprint previously applied on the same side. It can be determined well by a person skilled in the art as a matter of routine, by considerations of approximation and/or by experimentation.

In an advantageous embodiment, the mouthpiece lining paper is preferably not provided with a sealing lacquer coating completely on the outside, but especially at the end region remote from the tobacco rod of the finished cigarette, which is the end region that is touched by the lips during the smoking of the cigarette.

By not providing a sealing lacquer coating (or providing a less tight sealing lacquer coating) in the longitudinal region of the mouthpiece lining paper that is near the tobacco rod, which of course in any case is not touched by the lips, the air permeability of the mouthpiece lining paper can be allowed to remain higher there, as is advantageous in this region for setting the smoke values by admixing fresh air with the stream of smoke.

The application of a sealing layer according to the invention also extends the possibilities for applications of textured lacquers. A textured lacquer in the sense of this description is a lacquer with which a pattern of a texture that can be felt as raised can be printed on a surface.

The application of a sealing layer according to the invention not only prevents migration of substances from a lacquer coating of the mouthpiece lining paper. It also reduces or prevents entirely the migration of undesired substances from parts of the cigarette other than the lacquer coating of the mouthpiece lining paper to that surface of the mouthpiece lining paper that is touched by the lips of the person smoking the cigarette. This achieves the effect in comparison with the prior art that the imprint is better protected from influences from inside the cigarette and this protection is also sustained for longer in the presence of moisture. Thus, the migration of substances when moisture occurs, as is the case at least during the gluing and smoking, is also reduced even more reliably in comparison with the prior art.

What is claimed is:

1. A smoking article comprising:

a filter; and a mouthpiece lining paper, having an inside surface attached to the smoking article enclosing the filter;

wherein the mouthpiece lining paper further comprises:

an imprinted lacquer coating, which is applied on the inside surface of a mouthpiece lining paper forming a continuous solid film which has a visual or haptic function or comprises a sensory substance; and a moisture-resistant inner sealing layer, that is a continuous solid film formed by lacquer, applied on the inside of the mouthpiece lining paper, wherein said moisture-resistant inner sealing layer is placed on the imprinted lacquer coating, and wherein the lacquer of the moisture-resistant inner sealing layer is a different composition and is a more moisture-resistant lacquer than that of the imprinted lacquer coating.

2. The smoking article as claimed in claim 1, wherein the lacquer of the moisture-resistant inner sealing layer is shellac or ethyl cellulose lacquer or is a lacquer that comprises polyethylene wax.

3. The smoking article as claimed in claim 1, wherein the imprinted lacquer coating has a visual appearance.

4. The smoking article as claimed in claim 1, wherein the imprinted lacquer coating has a haptic function.

5. The smoking article as claimed in claim 1, wherein the imprinted lacquer coating comprises a sensory substance.

6. The smoking article as claimed in claim 5, wherein the lacquer of the imprinted lacquer coating is a carrier substance for the sensory substance.

7. The smoking article as claimed in claim 6, wherein the carrier substance for the sensory substance is nitrocellulose lacquer.

8. The smoking article as claimed in claim 1, wherein, in addition to the imprinted lacquer coating, a sensory substance has been applied.

9. The smoking article as claimed in claim 1, wherein an imprinted lacquer coating is applied to both on the inside and on the outside of the mouthpiece lining paper.

10. The smoking article as claimed in claim 1, wherein said mouthpiece lining paper is transparent.

11. The smoking article as claimed in claim 1, wherein an additional outer sealing layer, formed by lacquer, has been applied on the outside of the mouthpiece lining paper.

12. The smoking article as claimed in claim 11, wherein the outer sealing layer applied on the outside of the mouthpiece lining paper only extends over a part of the mouthpiece lining paper that is remote from a tobacco rod of the smoking article, which is the end region that is touched by the lips during the smoking of the smoking article.

13. The smoking article as claimed in claim 1, wherein the lacquer of the imprint is a textured lacquer.

14. The smoking article as claimed in claim 1, wherein the inner sealing layer is formed by applying successively multiple layers of lacquer.

15. The smoking article as claimed in claim 1, wherein the inner sealing layer only extends over part of a length of the mouthpiece lining paper.

16. The smoking article as claimed in claim 15, wherein the inner sealing layer extends over a part of the mouthpiece lining paper that is remote from a tobacco rod of the smoking article, which is the end region that is touched by the lips during the smoking of the smoking article.

* * * * *